US006571837B2

(12) United States Patent
Jansen et al.

(10) Patent No.: US 6,571,837 B2
(45) Date of Patent: Jun. 3, 2003

(54) TRANSFER SET FOR VIALS AND MEDICAL CONTAINERS

(75) Inventors: Hubert Jansen, Jarrie (FR); Jean-Claude Thibault, Saint Egreve (FR)

(73) Assignee: Becton Dickinson France S.A., Le Pont de Claix (FR)

( * ) Notice: Subject to any disclaimer, the term of this patent is extended or adjusted under 35 U.S.C. 154(b) by 182 days.

(21) Appl. No.: 09/767,791

(22) Filed: Jan. 23, 2001

(65) Prior Publication Data

US 2001/0003996 A1 Jun. 21, 2001

Related U.S. Application Data

(63) Continuation of application No. 09/420,998, filed on Oct. 20, 1999, now Pat. No. 6,209,738, which is a continuation-in-part of application No. 09/168,502, filed on Oct. 8, 1998

(60) Provisional application No. 60/082,372, filed on Apr. 20, 1998.

(51) Int. Cl.[7] ..... B65B 1/04

(52) U.S. Cl. ..... 141/329; 215/247; 215/258; 215/307; 215/355; 215/DIG. 3; 222/83; 604/414; 604/413; 604/415

(58) Field of Search ..... 215/249, 247, 215/258, 295, 296, 297, 308, 307, 355, DIG. 3; 222/81, 83, 83.5; 141/2, 25, 27, 28, 329, 330, 18, 21; 604/403, 406, 415, 412, 413–416

(56) References Cited

U.S. PATENT DOCUMENTS

| | | | |
|---|---|---|---|
| 37,221 | A | 12/1862 | Dunton |
| 659,519 | A | 10/1900 | De Oliveria |

(List continued on next page.)

FOREIGN PATENT DOCUMENTS

| | | |
|---|---|---|
| EP | O 236 127 A2 | 3/1987 |
| EP | O 406 374 B1 | 12/1989 |
| EP | O 065 469 A2 | 5/1992 |

(List continued on next page.)

OTHER PUBLICATIONS

German patent No. DE 36 18 158 A1, May 30, 1996.
Swiss Patent No. 501 172, Dec. 31, 1970.

(List continued on next page.)

*Primary Examiner*—Steven O. Douglas
(74) *Attorney, Agent, or Firm*—David M. Fortunato

(57) ABSTRACT

A transfer set assembly for transferring fluids between a first container, such as a conventional medical vial, having a sealed open end and a second container such as a conventional IV infusion bag. The transfer set includes a collar having a proximate tubular end portion for securement to the container, a needle cannula and holder assembly, which is telescopically received in a distal tubular portion of the collar, and a closure including a tubular body portion having an open proximate end which is telescopically received over the needle cannula and holder assembly and the distal tubular portion of the collar, a closed distal end portion and an inner tubular portion which is integral with the closed distal end. The inner tubular portion includes a free end having spiral camming surfaces which mate with spiral camping surfaces on the inside surface of the tubular distal portion of the needle cannula holder. The tubular body portion of the closure includes lateral slots which receive projections on the collar and contiguous camming surface which extends toward the proximate open end of the closure. Rotation of the closure relative to the collar first drives the mating spiral camming surfaces of the closure and holder together, thereby driving the needle cannula and holder assembly axially to pierce the seal of the container. Continued rotation of the closure drives the projections on the collar against the contiguous angled camming surface, driving the closure from the collar and providing access to the needle cannula for transfer of fluids to a second container, such as an IV infusion bag.

16 Claims, 17 Drawing Sheets

U.S. PATENT DOCUMENTS

| | | | |
|---|---|---|---|
| 2,342,215 | A | 2/1944 | Perelson |
| 2,388,634 | A | 11/1945 | De Woody |
| 2,524,365 | A | 10/1950 | Smith |
| 2,607,503 | A | 8/1952 | Sonnenberg |
| 2,653,609 | A | 9/1953 | Smith |
| 2,659,370 | A | 11/1953 | Smith |
| 2,667,986 | A | 2/1954 | Perelson |
| 2,953,132 | A | 3/1960 | Richter et al. |
| 3,033,202 | A | 5/1962 | Richter et al. |
| 3,164,303 | A | 1/1965 | Trautmann |
| 3,206,080 | A | 9/1965 | Scislowicz |
| 3,278,063 | A | 10/1966 | Kranzhoff |
| 3,356,093 | A | 12/1967 | Monahon |
| 3,357,427 | A | 12/1967 | Wittke et al. |
| 3,610,297 | A | 10/1971 | Raaf et al. |
| 3,674,028 | A | 7/1972 | Ogle |
| 3,779,371 | A | 12/1973 | Rovinksi |
| 3,810,469 | A | 5/1974 | Hurschman |
| 3,826,260 | A | 7/1974 | Killinger |
| 3,838,689 | A | 10/1974 | Cohen |
| 3,872,992 | A | 3/1975 | Larson |
| 3,940,003 | A | 2/1976 | Larson |
| 3,977,555 | A | 8/1976 | Larson |
| 3,995,630 | A | 12/1976 | Van De Veerdonk |
| 4,020,839 | A | 5/1977 | Klapp |
| 4,048,999 | A | 9/1977 | Kobel |
| 4,067,440 | A | 1/1978 | Lataix |
| 4,153,057 | A | 5/1979 | Kobel |
| 4,187,893 | A | 2/1980 | Bujan |
| 4,210,255 | A | 7/1980 | Pan |
| 4,296,786 | A | 10/1981 | Brignola |
| 4,336,891 | A | 6/1982 | Smith |
| 4,387,879 | A | 6/1983 | Tauschinski |
| 4,412,623 | A | 11/1983 | Schmidt |
| 4,418,827 | A | 12/1983 | Butterfield |
| 4,425,120 | A | 1/1984 | Sampson et al. |
| 4,460,735 | A | 7/1984 | Froix |
| 4,493,348 | A | 1/1985 | Lemmons |
| 4,505,709 | A | 3/1985 | Froning et al. |
| 4,507,113 | A | 3/1985 | Dunlap |
| 4,564,054 | A | 1/1986 | Gustavsson |
| 4,573,506 | A | 3/1986 | Paoletti |
| 4,573,976 | A | 3/1986 | Sampson et al. |
| 4,576,211 | A | 3/1986 | Valentini et al. |
| 4,588,403 | A | 5/1986 | Weiss et al. |
| 4,619,651 | A | 10/1986 | Kopfer et al. |
| 4,624,393 | A | 11/1986 | Lopez |
| 4,639,250 | A | 1/1987 | Rycroft |
| 4,662,878 | A | 5/1987 | Lindmayer |
| 4,672,996 | A | 6/1987 | Floyd et al. |
| 4,673,404 | A | 6/1987 | Gustavsson |
| 4,675,020 | A | 6/1987 | Mc Phee |
| 4,792,053 | A | 12/1988 | Towne et al. |
| 4,822,351 | A | 4/1989 | Purcell |
| 4,826,491 | A | 5/1989 | Schramm |
| 4,834,149 | A | 5/1989 | Fournier et al. |
| 4,834,152 | A | 5/1989 | Howson et al. |
| 4,850,994 | A | 7/1989 | Zerbet et al. |
| 4,884,703 | A | 12/1989 | O'Meara |
| 4,909,290 | A | 3/1990 | Coccia |
| 4,913,945 | A | 4/1990 | Maruhashi et al. |
| 4,923,447 | A | 5/1990 | Morgan |
| 4,927,423 | A | 5/1990 | Malmborg |
| 4,932,937 | A | 6/1990 | Gustavsson et al. |
| 4,982,740 | A | 1/1991 | Broden |
| 5,006,118 | A | 4/1991 | Yule |
| 5,024,256 | A | 6/1991 | Vadjer |
| 5,035,689 | A | 7/1991 | Schroeder |
| 5,060,812 | A | 10/1991 | Ogle, II |
| 5,088,996 | A | 2/1992 | Kopfer et al. |
| 5,092,840 | A | 3/1992 | Healy |
| 5,116,326 | A | 5/1992 | Schmidt |
| 5,169,385 | A | 12/1992 | Turnball |
| 5,171,214 | A | 12/1992 | Kolber et al. |
| 5,215,538 | A | 6/1993 | Larkin |
| 5,217,433 | A | 6/1993 | Bunin |
| 5,232,029 | A | 8/1993 | Knox et al. |
| 5,232,109 | A | 8/1993 | Tirrell et al. |
| 5,250,037 | A | 10/1993 | Bitdinger |
| 5,275,299 | A | 1/1994 | Konrad et al. |
| 5,279,576 | A | 1/1994 | Loo et al. |
| 5,291,991 | A | 3/1994 | Meyer |
| 5,297,599 | A | 3/1994 | Bucheli |
| 5,342,319 | A | 8/1994 | Watson et al. |
| 5,348,548 | A | 9/1994 | Meyer et al. |
| 5,350,372 | A | 9/1994 | Ikeda et al. |
| 5,352,196 | A | 10/1994 | Haber et al. |
| 5,358,501 | A | 10/1994 | Meyer |
| 5,360,413 | A | 11/1994 | Leason et al. |
| 5,364,386 | A | 11/1994 | Fukuoka et al. |
| 5,385,546 | A | 1/1995 | Kriesel et al. |
| 5,397,303 | A | 3/1995 | Sancoff et al. |
| 5,409,125 | A | 4/1995 | Kimber et al. |
| 5,411,499 | A | 5/1995 | Dudar et al. |
| 5,415,374 | A | 5/1995 | Carrol et al. |
| 5,419,256 | A | 5/1995 | Pollich |
| 5,421,814 | A | 6/1995 | Geary |
| 5,423,791 | A | 6/1995 | Bartlett |
| 5,425,465 | A | 6/1995 | Healy |
| 5,429,256 | A | 7/1995 | Kestenbaum |
| 5,433,330 | A | 7/1995 | Yatsko et al. |
| 5,433,703 | A | 7/1995 | Utterberg et al. |
| 5,435,282 | A | 7/1995 | Haber et al. |
| 5,437,648 | A | 8/1995 | Graves et al. |
| 5,441,487 | A | 8/1995 | Vedder |
| 5,454,409 | A | 10/1995 | Mc Affer et al. |
| 5,454,805 | A | 10/1995 | Brony |
| 5,466,219 | A | 11/1995 | Lynn et al. |
| 5,470,319 | A | 11/1995 | Mayer |
| 5,470,327 | A | 11/1995 | Helgren et al. |
| 5,474,541 | A | 12/1995 | Ritsky et al. |
| 5,474,544 | A | 12/1995 | Lynn |
| 5,487,737 | A | 1/1996 | Meyer |
| 5,494,170 | A | 2/1996 | Burns |
| 5,501,676 | A | 3/1996 | Niedospial et al. |
| 5,514,116 | A | 5/1996 | Vaillancourt et al. |
| 5,514,117 | A | 5/1996 | Lynn |
| 5,520,641 | A | 5/1996 | Behnke et al. |
| 5,520,642 | A | 5/1996 | Bigagli et al. |
| 5,520,661 | A | 5/1996 | Lal et al. |
| 5,520,665 | A | 5/1996 | Fleetwood |
| 5,520,666 | A | 5/1996 | Choudhury et al. |
| 5,533,983 | A | 7/1996 | Haining |
| 5,533,994 | A | 7/1996 | Meyer |
| 5,549,651 | A | 8/1996 | Lynn |
| 5,566,729 | A | 10/1996 | Grabenkort et al. |
| 5,573,516 | A | 11/1996 | Tyner |
| 5,573,520 | A | 11/1996 | Schwartz et al. |
| 5,573,525 | A | 11/1996 | Watson et al. |
| 5,573,526 | A | 11/1996 | Hess |
| 5,576,392 | A | 11/1996 | Yamamoto et al. |
| 5,598,939 | A | 2/1997 | Watson et al. |
| 5,613,291 | A | 3/1997 | Solomon et al. |
| 5,616,129 | A | 4/1997 | Mayer |
| 5,616,130 | A | 4/1997 | Mayer |
| 5,620,434 | A | 4/1997 | Brony |
| 5,641,010 | A | 6/1997 | Maier |
| 5,662,230 | A | 9/1997 | Finnneran |
| 5,685,845 | A | 11/1997 | Grimard |
| 5,697,915 | A | 12/1997 | Lynn |
| 5,702,019 | A | 12/1997 | Grimard |

| | | | |
|---|---|---|---|
| 5,709,666 | A | 1/1998 | Reynolds |
| 5,718,348 | A | 2/1998 | Manera |
| 5,776,124 | A | 7/1998 | Wald |
| 5,776,125 | A | 7/1998 | Dudar et al. |
| 5,785,701 | A | 7/1998 | Sams et al. |
| 5,803,284 | A | 9/1998 | Grimard |
| 5,819,964 | A | 10/1998 | Grimard |
| 5,833,089 | A | 11/1998 | Manni et al. |
| 5,855,575 | A | 1/1999 | Solomon et al. |
| 5,863,655 | A | 1/1999 | Mock |
| 5,873,872 | A | 2/1999 | Thibault et al. |
| 5,879,345 | A | 3/1999 | Aneas |
| 5,891,129 | A | 4/1999 | Daubert et al. |
| 5,925,029 | A | 7/1999 | Jansen et al. |
| 5,931,828 | A | 8/1999 | Durkee |
| 5,954,104 | A | 9/1999 | Daubert et al. |
| 5,957,898 | A | 9/1999 | Jepson et al. |
| 6,003,566 | A | 12/1999 | Thibault et al. |
| 6,050,435 | A | 4/2000 | Bush et al. |
| 6,056,135 | A | 5/2000 | Widman |
| 6,070,623 | A | 6/2000 | Aneas |

FOREIGN PATENT DOCUMENTS

| | | |
|---|---|---|
| EP | O 769 456 A2 | 10/1996 |
| EP | O 747 293 A1 | 12/1996 |
| WO | WO 84/04673 | 12/1984 |
| WO | WO 88/01881 | 3/1988 |
| WO | WO 92/11056 | 7/1992 |
| WO | WO 94/03373 | 2/1994 |
| WO | WO 95/00117 | 1/1995 |
| WO | WO 95/03841 | 2/1995 |
| WO | WO 95/14176 | 5/1995 |
| WO | WO 95/31242 | 11/1995 |
| WO | WO 95/33505 | 12/1995 |
| WO | WO 95/35125 | 12/1995 |
| WO | WO 96/13301 | 5/1996 |
| WO | WO 97/00702 | 1/1997 |
| WO | WO 97/10156 | 3/1997 |
| WO | WO 97/39720 | 10/1997 |
| WO | WO 98/13006 | 4/1998 |
| WO | WO 98/32411 | 7/1998 |
| WO | WO 98/37853 | 9/1998 |
| WO | WO 98/37854 | 9/1998 |

OTHER PUBLICATIONS

UK Patent Application No. 2 121 016 A, Jun. 1, 1983.
French Patent No. 950.625, Jul. 28, 1947.
French Patent No. 1.071.487, Feb. 26, 1953.
French Patent No. 1.328.635, Jul. 4, 1962.
French Patent No. 1.487.413, May 20, 1966.
French Patent No. 2.738.550, Sep. 9, 1995.
French Patent No. 2.395.198, Jan. 19, 1979.

TRANSFER SET FOR VIALS AND MEDICAL CONTAINERS

RELATED APPLICATIONS

This application is a continuation application of Ser. No. 09/420,998, filed Oct. 20, 1999, now U.S. Pat. No. 6,209,738, which is a continuation-in-part of application Ser. No. 09/168,502, filed Oct. 8, 1998, which claimed priority to provisional Application S. No. 60/082,372, filed Apr. 20, 1998.

FIELD OF THE INVENTION

This invention relates to an improved transfer set for vials and other medical containers which may be attached to a conventional vial, for example, having an elastomeric stopper or other closure for transferring fluid under sterile conditions between the medical container and a second container such as a conventional intravenous (IV) infusion bag. The transfer set of this invention assures sterile delivery of the substance in the container, provides clear indication of tampering and protects the healthcare worker.

BACKGROUND OF THE INVENTION

It is conventional to store pharmaceutical substances such as drugs in a sealed vial or other container for later use. Such pharmaceuticals may be in a dry or powdered form to increase the shelf life of the substance and reduce inventory space. Such dry or powdered substances are generally stored in a sealed vial and reconstituted in liquid form for administration to a patient by adding diluent or solvent. Alternatively, the substance may in a liquid or even a gaseous form.

A conventional vial for storing such substances generally includes an open end, a radial rim portion surrounding the open end and a reduced diameter neck portion adjacent the rim portion. The vial is conventionally sealed with an elastomeric stopper or closure which includes a generally tubular portion or an annular rib which is inserted into the neck of the vial and a generally planar rim portion which overlies the vial rim. The stopper is normally secured to the vial with a thin malleable metal cap, such as aluminum. The aluminum cap includes a tubular portion which surrounds the rim portion of the stopper and vial, an inwardly projecting annular rim portion which overlies the rim portion of the stopper and a free end portion which is crimped or deformed radially into the vial neck beneath the vial rim portion. Because aluminum is malleable, the collar accommodates the buildup of tolerances of the dimensions of the stopper and rim portion. The dimensions and tolerances of standard vials and rims are set by the International Standards Organization (ISO).

The radial portion of the aluminum cap which overlies the stopper rim portion may be closed, in which case the aluminum cap is removed by peeling the aluminum cap from the vial. A pre-slit tab located in the midportion is provided which overlies the vial rim, permitting the cap to be torn from the top and peeled from the vial prior to use. This embodiment of an aluminum cap has several disadvantages. First, the tearing the metal cap creates sharp edges which may cut or damage sterile gloves and cut the healthcare person administering the drug, thereby exposing both the healthcare worker and the patient to disease and contamination of the drug. Second, the tearing of the aluminum cap generates metal particles which may also contaminant the drug. The dangers associated with the tearing of an aluminum cap has been solved in part by adding a "flip-off" plastic cap. This embodiment, however, does not eliminate the possibility of tearing the sterile gloves of the healthcare worker. Further, aluminum dust is still created which may contaminant the medicament. It should also be noted that metallic dust is also created by forming and affixing the aluminum collar to the vial, particularly during the crimping of the vial and removal of the flip-off plastic cap.

Aluminum collars have also been used to secure fluid transfer sets on vials. Transfer sets may be utilized, for example, to transfer fluid from a syringe to a vial or an IV infusion bag to a vial such as to reconstitute a dry or powdered drug in a vial by adding diluent or solvent. The reconstituted drug may then be withdrawn from the vial into the IV infusion bag or a syringe. There have been attempts to reduce this problem by applying a coating to the aluminum cap or collar. The prior art also includes snap-on cup-shaped plastic caps or collars having a radially inwardly projecting end portion that is snapped over the rim portion of the vial. Snap-on plastic collars, however, do not assure adequate sealing of the vial or full accommodation of the tolerances of standard vials and stoppers as required.

As discussed below, the disclosed embodiment of the fluid transfer set of this invention is particularly, but not exclusively, adapted for transferring fluids between a sealed container, such a vial having an elastomeric stopper, and an IV infusion bag. A conventional IV infusion bag includes one or a plurality of tubular ports which are sealed prior to use. As set forth above, the vial or other medical container is also sealed. The transfer of fluids between a vial and an IV infusion bag for example requires piercing of the seal in the port to the IV infusion bag and communication with the interior of the vial generally provided by piercing the elastomeric stopper. In a typical application, the vial includes a dry or powdered substance and the IV infusion bag includes a liquid solvent or diluent. It is thus necessary to transfer the liquid in the IV infusion bag to the dry or powdered medicament in the vial to reconstitute the drug, then transfer the reconstituted drug to the IV infusion bag.

Various improvements have been made to transfer sets for transferring fluid between medicament vials and IV infusion sets, particularly the MONOVIAL® prefillable IV infusion system offered by the assignee of the present invention as disclosed, for example, in U.S. Pat. Nos. 5,487,737; 5,533,994; and particularly 5,855,575 assigned to the Assignee of the present invention. These improvements include safeguards against damage and contamination and a shield around the needle cannula used to pierce the tubular port of IV infusion bag which safeguards the healthcare worker. This transfer set system, however, requires a special stopper or closure for the vial. Reference is also made to U.S. Pat. No. 5,250,037 assigned to the assignee of the present invention which discloses an improved syringe having needle isolation features, wherein the needle cannula extends from both ends of the needle holder for transfer of fluids between the syringe and a second container such as an IV infusion bag. The barrel portion includes bayonet grooves and the closure includes projections received in the bayonet grooves, such that rotation of the closure drives the proximate end of the needle cannula through a seal on the syringe. The transfer assembly disclosed in that patent, however, requires a special syringe.

The transfer set assembly of this invention may be utilized with any sealed container including conventional sealed pharmaceutical vials preferably having ports up to 14.5 mm and may be utilized to transfer fluids between the sealed container and any second container, including a conventional IV infusion bag. Further, the transfer set of this invention assures sterile conditions of the transfer set during filling of the container and use of the transfer set and container assembly. Finally, the transfer set of this invention is simple to operate and protects the healthcare worker during use.

SUMMARY OF THE INVENTION

As set forth above, the transfer set assembly of this invention may be utilized to transfer fluids between a first container having a sealed open end, such as a conventional vial having an elastomeric stopper, and a second container, such as a conventional IV infusion bag, under sterile conditions. It is important to emphasize, however that the use of the transfer set assembly of this invention is not limited to any particular container, such as the conventional vial or an IV infusion bag as described herein.

The transfer set assembly of this invention includes a collar, a needle cannula and holder assembly, and a closure. The collar includes a proximate tubular end portion which is adapted to be received over the sealed open end of the first container for securement to the container. In the most preferred embodiment of the transfer set assembly of this invention, the collar is formed of a polymer which is sufficiently malleable to permit radial deformation of the free end of the proximate tubular end portion, into the reduced diameter neck portion of a vial, for example, to secure the collar to the sealed open end of the first container, yet sufficiently rigid to maintain its shape following deformation and sufficiently resistant to creep to maintain the seal between the transfer set and the first container. The most preferred polymer is a composite polymer including a relatively soft malleable polymer and a relatively rigid polymer. The collar further includes an intermediate portion having an axial opening, which receives the needle cannula as described below, and a distal tubular portion. For ease of description and understanding, the term "distal" is used herein to refer to the portions of a component of the transfer set which are more distant or distal from the sealed container to which the transfer set is attached. The term "proximate" is used for the portion of a component which are closer or proximate to the container.

The needle cannula holder includes a proximate end portion which is telescopically received in the distal tubular portion of the collar and a tubular distal end portion. The tubular distal end portion of the holder includes an angled camming surface, or surfaces. The needle cannula is supported and secured in the holder and includes a free proximate end portion which projects axially beyond the proximate end portion of the holder for piercing the sealed open end of the first container as described below.

The closure or cap includes a tubular body portion having an open end which is telescopically received over the needle cannula and holder assembly and the distal tubular portion of the collar, a closed distal end portion and an angled camming surface or surfaces which engages the angled camming surfaces on the holder. Thus, rotation of the closure relative to the collar and the holder drives the needle cannula and holder assembly axially, causing the projecting end of the needle cannula to pierce the open end of the container and provide communication between the first container and a second container.

In the most preferred embodiment, the mating camming surfaces are helical and the closure and holder include two mating camming surfaces providing sufficient force to assure piercing of the sealed open end of the first container and balancing the driving force. Further, the distal tubular portion of the collar and the needle cannula holder include an interlocking axial rib and groove which permits telescopic movement of the needle cannula and holder assembly within the distal tubular portion of the collar while preventing rotational movement of the holder relative to the collar.

As described above, the mating camming surfaces of the closure and the needle cannula holder assure piercing of the sealed open end of the first container by the needle cannula. The closure may then be removed to establish communication between the first container and a second container. However, it would also be desirable to drive the closure from the needle cannula and holder assembly and the collar and provide evidence that the seal has been fully pierced. In the preferred embodiment, the open proximate end portion of the closure is closely telescopically received over the distal tubular portion of the collar to prevent contamination of the transfer set assembly and assure maintenance of sterile conditions. It is also desirable to securely retain the closure on the transfer set prior to use to assure the sterile condition of the transfer set and prior to full piercing of the sealed open end of the first container when the transfer set is ready for use.

These goals are accomplished in the disclosed embodiment of the transfer set of this invention by providing a laterally extending slot or groove adjacent the free open end of the tubular body portion of the closure and a projection on the distal tubular portion of the collar which is received in the slot. The inside surface of the tubular body portion of the closure further includes an angled camming surface contiguous with the slot which receives the projection on the collar when piercing of the sealed open end of the container by the needle cannula is complete. Thus, the closure is securely retained on the collar during the initial rotation of the collar to pierce the sealed open end of the container. In the disclosed preferred embodiment, two projections are provided on opposed sides of the tubular distal portion at the collar which are received in lateral slots on opposed sides of the closure. Continued rotation of the closure relative to the collar following piercing of the seal on the first container then disposes the projection on the collar into the contiguous angled camming surface, driving the closure from the collar. As will be understood, however, this arrangement can be reversed, wherein the projection is located on the internal surface of the body portion of the closure and the slot and camming surface is provided on the external surface of the distal tubular portion of the collar.

The transfer set assembly of this invention is thus simple to use and provides a substantially foolproof operation. When the transfer set is ready for use, the healthcare worker simply rotates the closure relative to the collar which drives the needle cannula and holder assembly axially to pierce the sealed opening of the first container. Continued rotation of the collar in the same direction then drives the closure from the collar, thereby releasing the closure and providing a clear indication to the healthcare worker that the closure may be removed and the transfer set is ready for use. Various tamper indicators may also be included with the transfer set assembly of this invention. First, the closure may be releasably affixed to the proximate tubular end portion of the collar by a frangible connector, such that when the closure is turned during use, the frangible connector is broken providing clear indication that the closure has been removed. Second, a frangible connector may be applied across the slot which receives the projection on the collar, indicating that the closure has been turned and preventing inadvertent rotation of the closure. The frangible connectors may take various forms including tape and an integral web which provides clear evidence of tampering.

The improved transfer set assembly of this invention thus achieves the goals of assuring the sterility of the transfer set assembly prior to and during use, is simple and positive in operation and protects the healthcare worker prior to and during use. In the disclosed embodiment of the transfer set assembly of this invention which is particularly, but not exclusively, adapted for transferring fluids between a first container having a sealed open end and a IV infusion bag, the needle cannula extends through the intermediate portion of the holder toward the closed distal end of the closure and the tubular distal portion of the holder extends beyond the free upper end of the needle cannula to serve as a shield for the healthcare worker. In the most preferred embodiment, the tubular distal portion includes axial slots which allows the healthcare worker to clearly see the exposed needle cannula for attachment to the port of the infusion bag and guides the tubular port. These and other advantages and meritorious features of the improved transfer set assembly of this invention will be more fully understood from the following description of the preferred embodiments, the claims and the drawings, a brief description of which follows.

DETAILED DESCRIPTION OF THE PREFERRED EMBODIMENT

Figure 1:
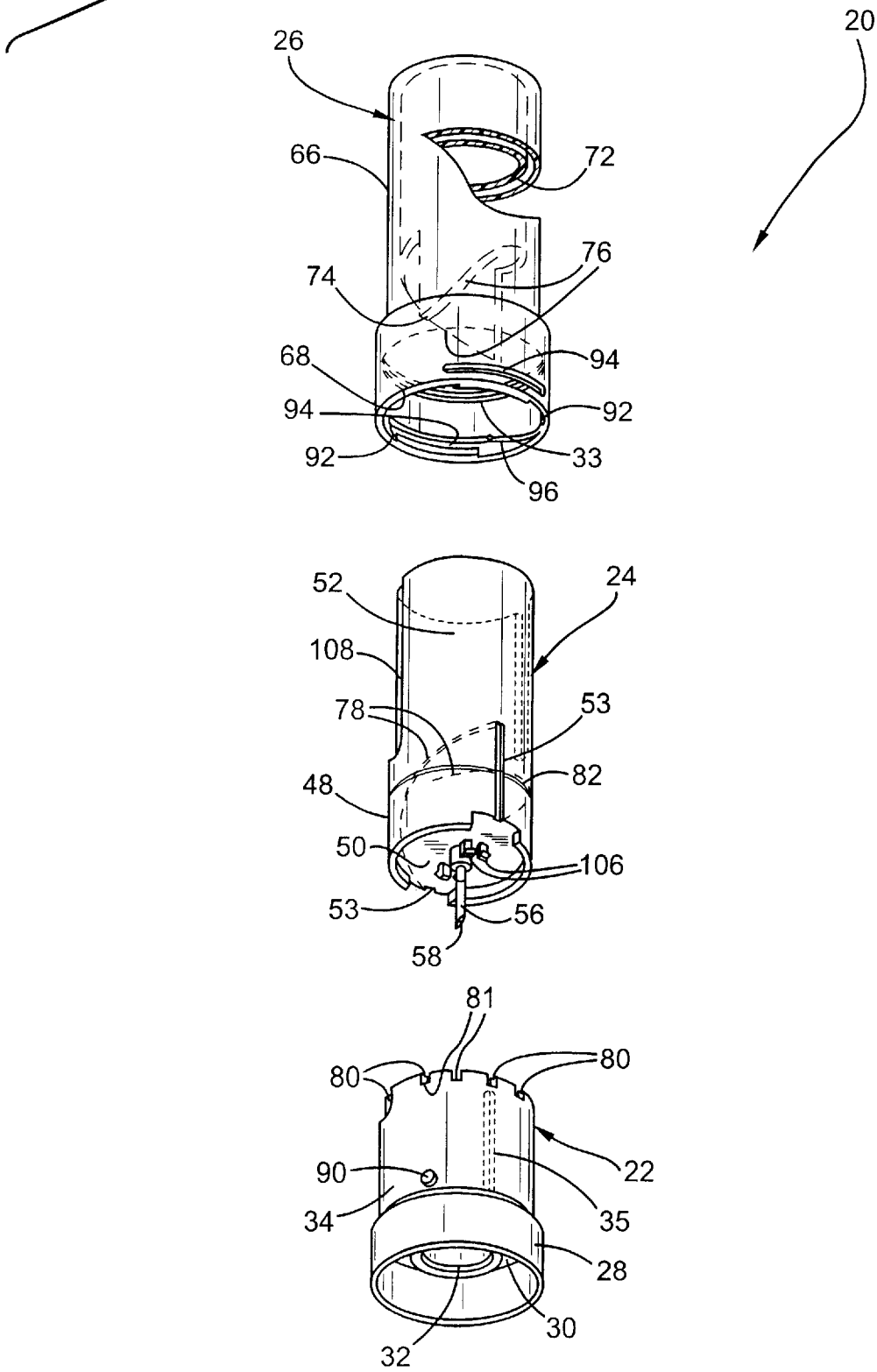
FIG. 1 is an exploded, partially cross-sectioned view of one embodiment of the transfer set assembly of this invention.
Figure 2A:
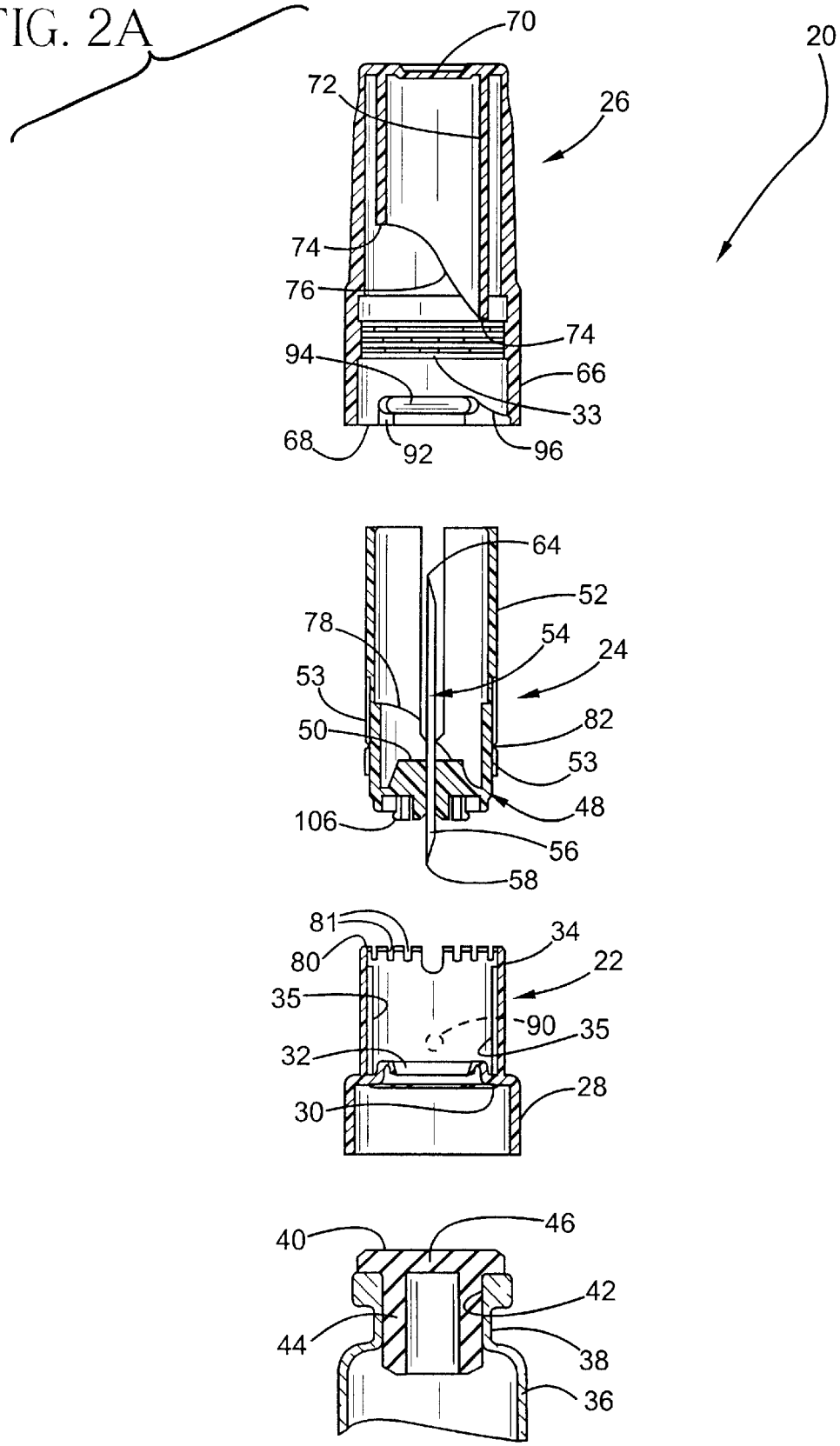
FIG. 2A is an exploded cross-sectional view of the transfer set assembly shown in FIG. 1 and a conventional medical vial.

Referring now to FIGS. 1 and 2A which are exploded views of one embodiment of the transfer set assembly of this invention, the transfer set assembly 20 includes a collar 22, a needle cannula and holder assembly 24 and a closure or cap 26. The collar 22 includes a proximate tubular end portion 28, an intermediate portion 30 having an axial configured opening 32 and a tubular distal portion 34. As described above, the disclosed embodiment of the transfer set assembly of this invention is particularly, but not exclusively, adapted for attachment to a conventional vial 36 as shown for example in FIG. 2A. A conventional vial has a reduced diameter neck portion 38 and an elastomeric stopper or seal 40 which is received in the open end 42 of the vial. A conventional stopper 40 includes a tubular portion 44 and a planar end portion 46. As will be understood by those skilled in this art, stoppers for conventional vials are available in various configurations and are generally formed of synthetic or natural rubber. Conventional vials are formed of glass or plastic. The external diameter of the tubular portion 44 of the stopper is generally slightly greater than the internal diameter of the opening 42 of the vial, such that the stopper forms a tight interference fit providing an excellent seal for the vial. The proximate tubular end portion 28 is adapted to be received over the open end 42 of the vial for securement thereto as described below.

The needle cannula and holder assembly 24 includes a needle cannula holder 48 having a proximate end portion 50 and a tubular distal portion 52. The needle cannula 54 is securely retained in the proximate end portion 50 of the holder 24 and includes a first proximate end portion 56 which extends axially beyond the proximate end portion 50 of the holder having a sharp edge 58 for piercing the planar end portion 46 of the stopper as described below. In the disclosed embodiment of the transfer set assembly adapted for transferring fluid between the vial 36 and an IV infusion bag described below, the needle cannula 54 includes a second distal end portion 60 having a sharp edge 64.

The closure or cap 26 includes a tubular body portion 66, a proximate open end 68 and a closed distal end 70. In the embodiment of the transfer set assembly of FIGS. 1 through 6, the closure further includes an inner cylindrical tubular portion 72 having a free end 74 which includes spiral camming surfaces 76 which mate with spiral camming surfaces 78 on the internal surface of the tubular distal portion 52 of the needle cannula holder 48 as described above. In another example, which is illustrated in FIGS. 8 through 11, the inner tubular portion 72 is not used and the camming surfaces are relocated. In the example of FIGS. 1 to 6 of the closure 26, the inner tubular portion 72 is integral with the closed distal end 70 and is generally coaxially aligned with, but spaced from the tubular body portion 66 as shown. As will be understood, the term "tubular" as used herein is not intended to limit the shape of the tubular form which may be cylindrical, polygonal, etc. except where specifically described.

Figure 2B:
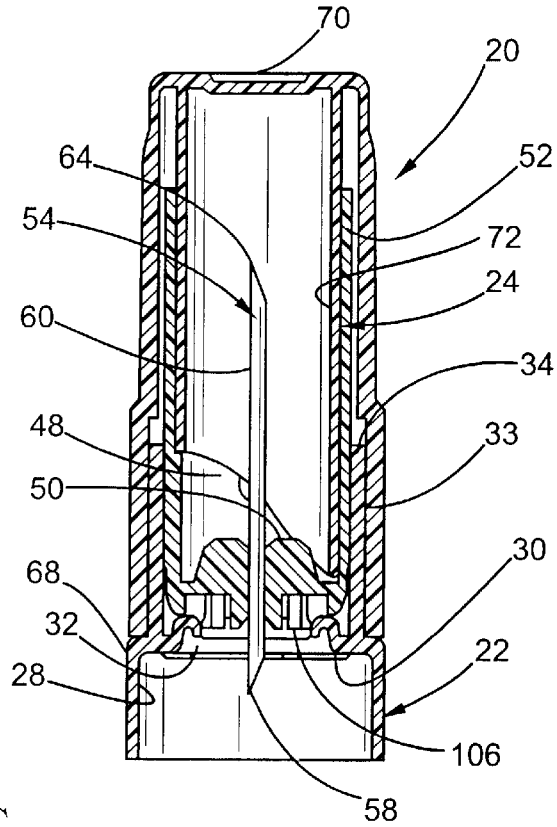
FIG. 2B is a cross-sectional view of the cross-sectional view of the assembled transfer set.
Figure 2C:
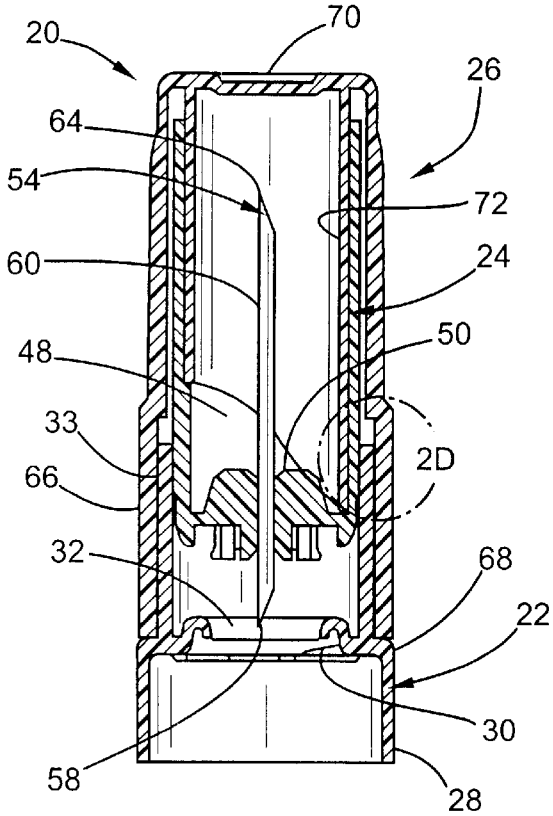
FIG. 2C is a cross-sectional view similar to FIG. 2B following retraction of the needle cannula.
Figure 2D:
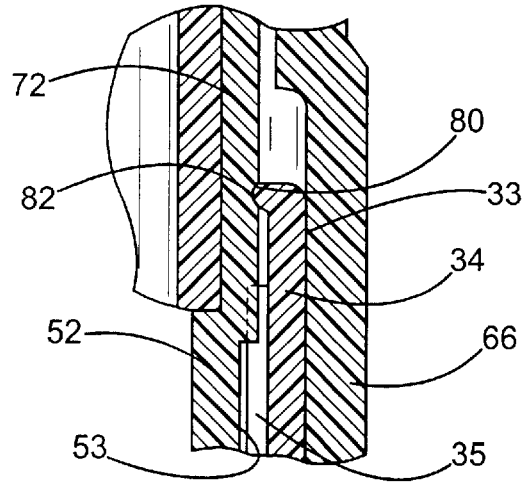
FIG. 2D is an enlarged cross-sectional view of FIG. 2C.
Figure 2E:
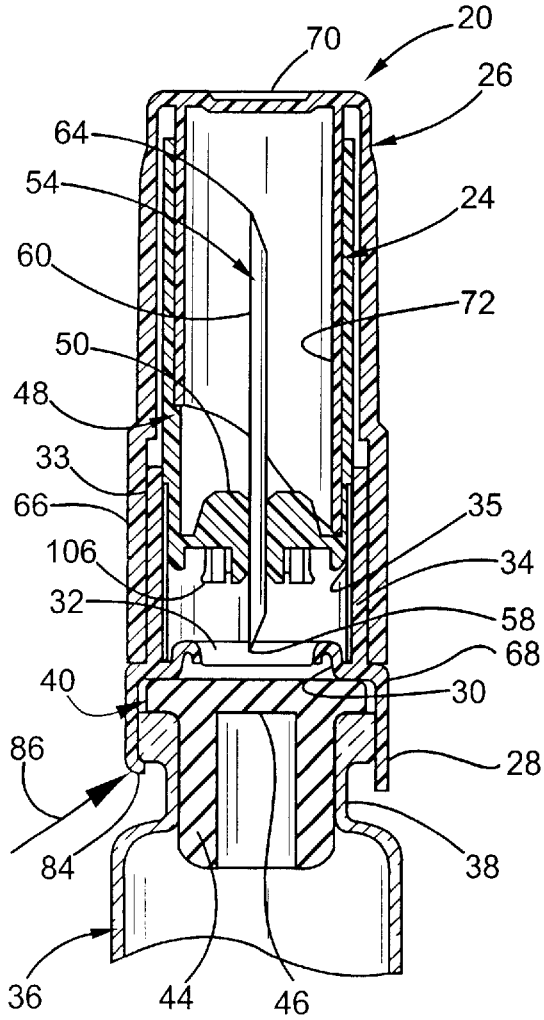
FIG. 2E is a cross-sectional view of the transfer set assembly shown in FIG. 2C during installation of the transfer set on a conventional vial.

FIG. 2B illustrates the transfer set assembly following initial assembly of the components. As shown, the proximate end portion 50 of the needle holder 48 is telescopically received in the tubular distal portion 34 of the collar 22 until the proximate end engages the intermediate portion 30 of the collar. The needle cannula holder 24 must be initially located in this position to receive the closure 26 because of the interference of the spiral camming surfaces. As shown in FIG. 2B, the open end 68 of the closure is then telescopically disposed over the needle cannula and holder assembly 24, wherein the inner tubular portion 72 is received within the tubular distal portion 52 of the holder and the open end is then received over the tubular distal portion 34 of the collar as shown. The needle cannula and holder assembly 24 is then repositioned upwardly or retracted as shown in FIG. 2C until the internal rib 80 at the free end of the tubular distal portion 34 of the collar snaps into the annular groove 82 of the needle holder as best shown in FIG. 2D. The interlock between the rib 80 and the groove 82 then temporarily holds the needle cannula and holder assembly in the position shown in FIG. 2C. The transfer set assembly 20 is then ready for installation on the first container and shown in FIG. 2E.

As stated above, the proximate tubular end portion 28 of the collar 22 is adapted for attachment to a sealed first container, which in the disclosed embodiment is a conventional vial 36 sealed with a stopper 40. In this embodiment, the free end 84 is permanently deformed, crimped or spun radially inward toward or into the neck portion 38 of the vial as shown by arrow 86. During this installation, the intermediate portion 30 of the collar is pressed into the planar end portion 46 of the resilient elastomeric stopper providing an excellent seal. In the most preferred embodiment, the intermediate portion 30 of the collar includes an annular relatively sharp projecting rib 88 which bites into the planar end portion 46 of the resilient elastomeric stopper, further improving the seal and resisting relative rotation. As set forth above, however, the transfer set assembly of this invention may be utilized for transferring fluid between any first container and a second container and therefore the transfer set of this invention is not limited to the means of attaching the transfer set to the first container.

The components of the transfer set assembly excluding the needle cannula 54 are preferably formed of polymers, most preferably clear polymers, which permit the healthcare worker to view the components of the transfer set assembly prior to and during use.

The preferred polymers selected for the components of the transfer set assembly of the invention will depend upon the particular application. The most preferred polymer for the collar can best be described by its properties. The polymer should be sufficiently malleable to permit radial deformation or crimping as described, yet sufficiently rigid to retain its shape following deformation. The polymer should also be sufficiently resistant to creep to maintain the seal between the transfer set assembly and the container following radial deformation. It has been found that a polymer having an elongation at yield between 5% and 10% and an elongation at break greater than 100%, combined with a flectual modulas of greater than 1900 MPa has superior performance. Where the transfer set assembly of this invention is used for sealed vials or other containers containing a pharmaceutical substance, the selected polymers should also be sterilizable and, in certain applications such as the transfer set assembly of this invention, the polymer is preferably relatively clear as set forth above and maintains its clarity under the stress of deformation or crimping. It has been found that certain composite polymers such as polymer alloys or composite polymers including melt blends or alloys and copolymers having polymers of different malleability and rigidity are preferred in such applications. That is, the collar of the transfer set of this invention is preferably formed of a polymer alloy, composite polymer or copolymer including a relatively rigid polymer and a tough relatively soft malleable copolymer. The most preferred polymer is a polymer alloy or melt blend including a polyamide or polycarbonate as the rigid polymer providing the strength and resistance to creep desired for this application. The relatively soft malleable copolymer may be selected from various polymers including polyesters and polyolefins; however, a polymer alloy including in a polymer carbonate or polyamide has been found particularly suitable for this application.

As will be understood, various composite polymers including polymeric melt blends, alloys, composites and co-polymers are being developed on a rapidly increasing basis and therefore the material selected for the plastic collar and components of the transfer set of this invention is not limited to a specific polymer, provided the polymers have the desired physical properties described for the application. Suitable polymers for the plastic collar of the transfer set of this invention include EASTAR® MB polymers, which are melt blend and alloy polymers and EASTAR® thermoplastic polymers, which are neat polymers sold by Eastman Chemical Company of Kingsport, Tenn. and Eastman Chemical AG of Zug, Switzerland under the trade names "DA003, DN003" and "DN004". These materials are polymer melt blends, alloys and co-polymers of polycarbonate or polyamide and polyester. As used herein, the terms melt blends and alloys refer to polymeric compositions having two or more polymers of different physical properties or characteristics, such as the EASTAR® polymers of Eastman Chemical Company described above which include a polycarbonate or polyamide and a polyester. The polymer selected may also include fillers and other constituents which would be more accurately described as a composite although the base polymers may still be a polymeric melt blend or alloy. As used herein, the term composite is used in its broadest sense to include alloys or melt blends, composites and co-polymers. As will be understood, the manufacturer or supplier of the raw material will normally blend the polymers based upon the specifications of the customer. The polymers may be co-injected to form a polymeric melt blend, alloy or composite or formed by any other suitable processes. It is anticipated, however, that other polymers having the described physical characteristics may also be utilized for the plastic collar and the other components of the transfer set of this invention. In certain applications, it may also be desirable to coat at least the interior surfaces of the components of the transfer set with a thermoplastic elastomer. The thermoplastic elastomer coating may be applied as a film or by co-injection. The components set assembly 20 may be formed by conventional injection molding processes.

Figure 3A:
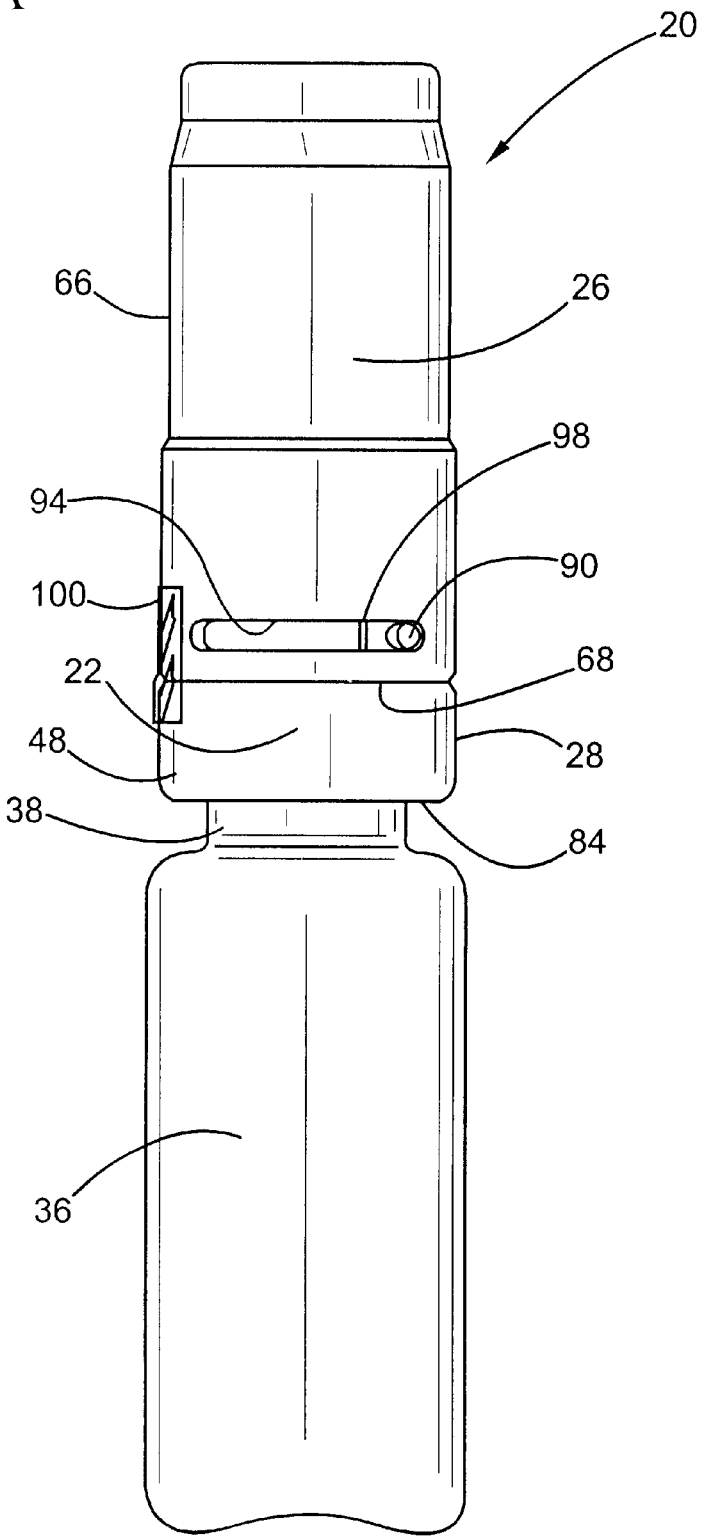
FIG. 3A is a side elevation of the transfer set assembled on a conventional vial.
Figure 3B:
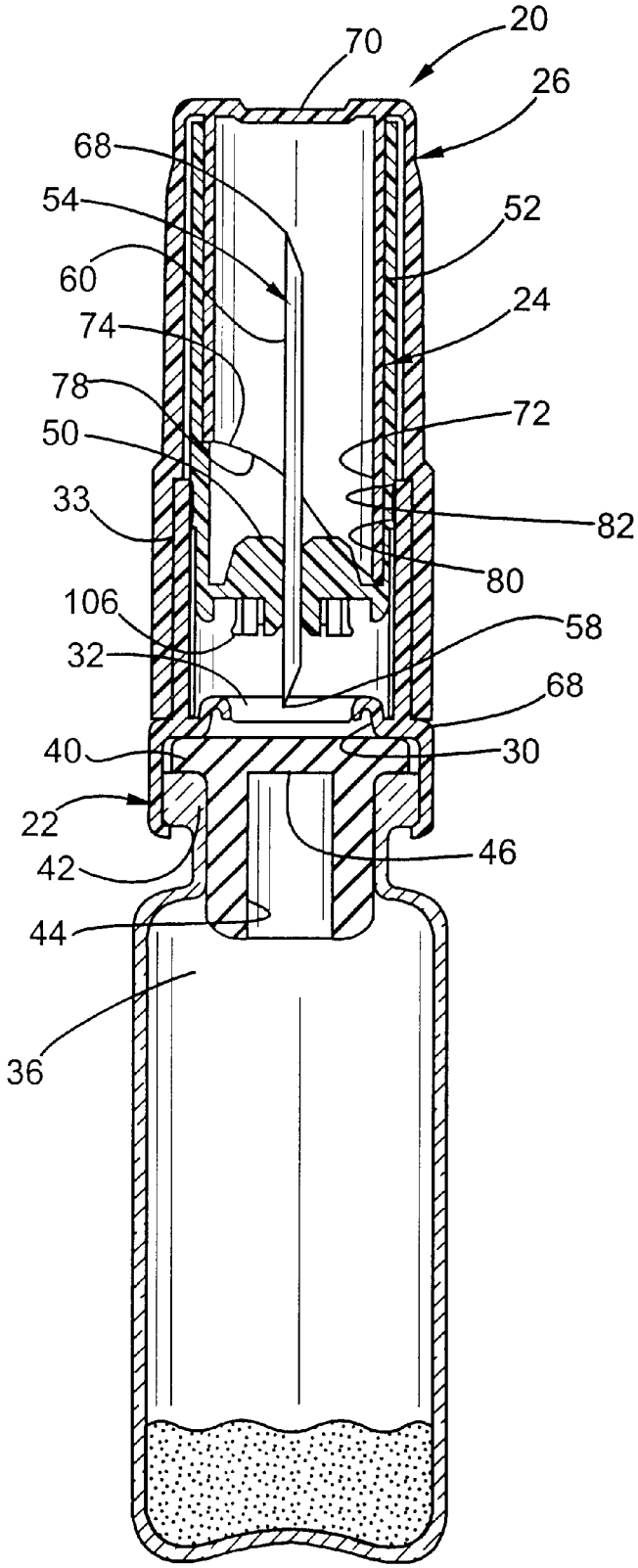
FIG. 3B is a side cross-sectional view of FIG. 3A.
Figure 5A:
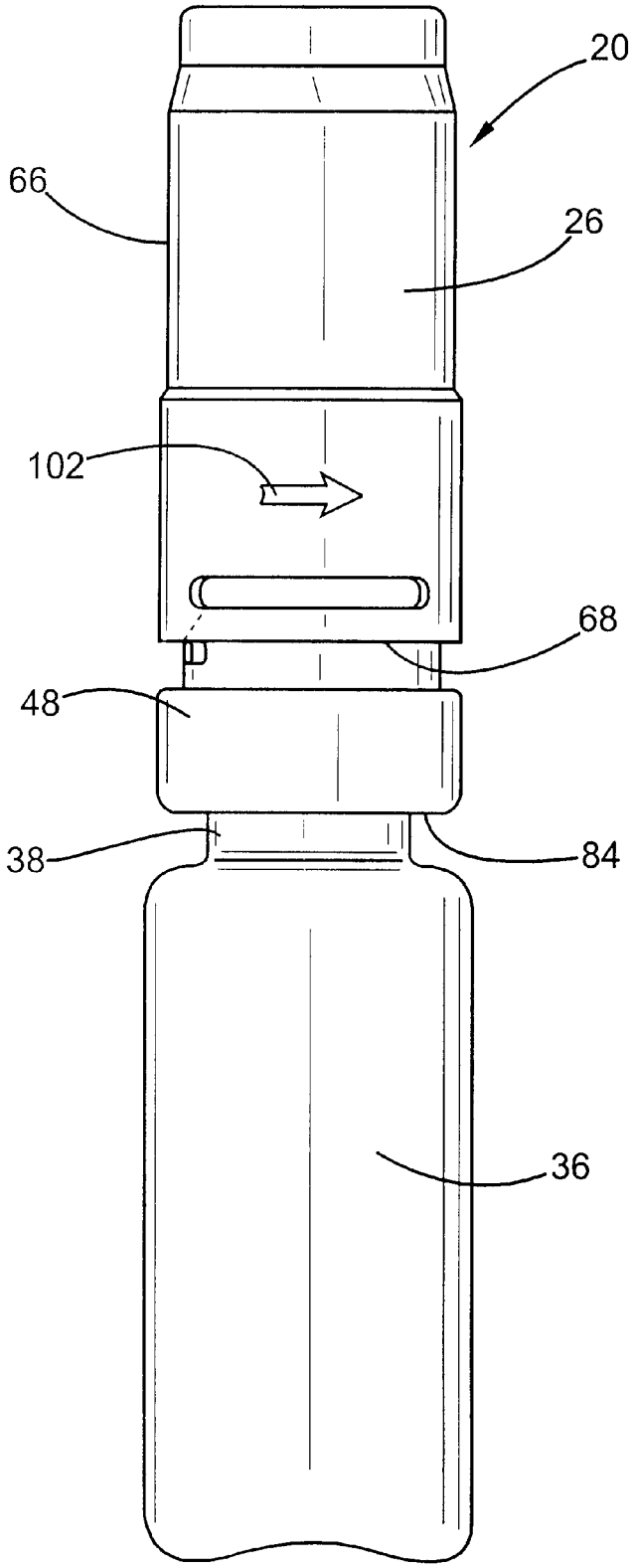
FIG. 5A is a cross-sectional view of the transfer set and container assembly following further rotation of the closure, which drives the closure from the collar.
Figure 5B:
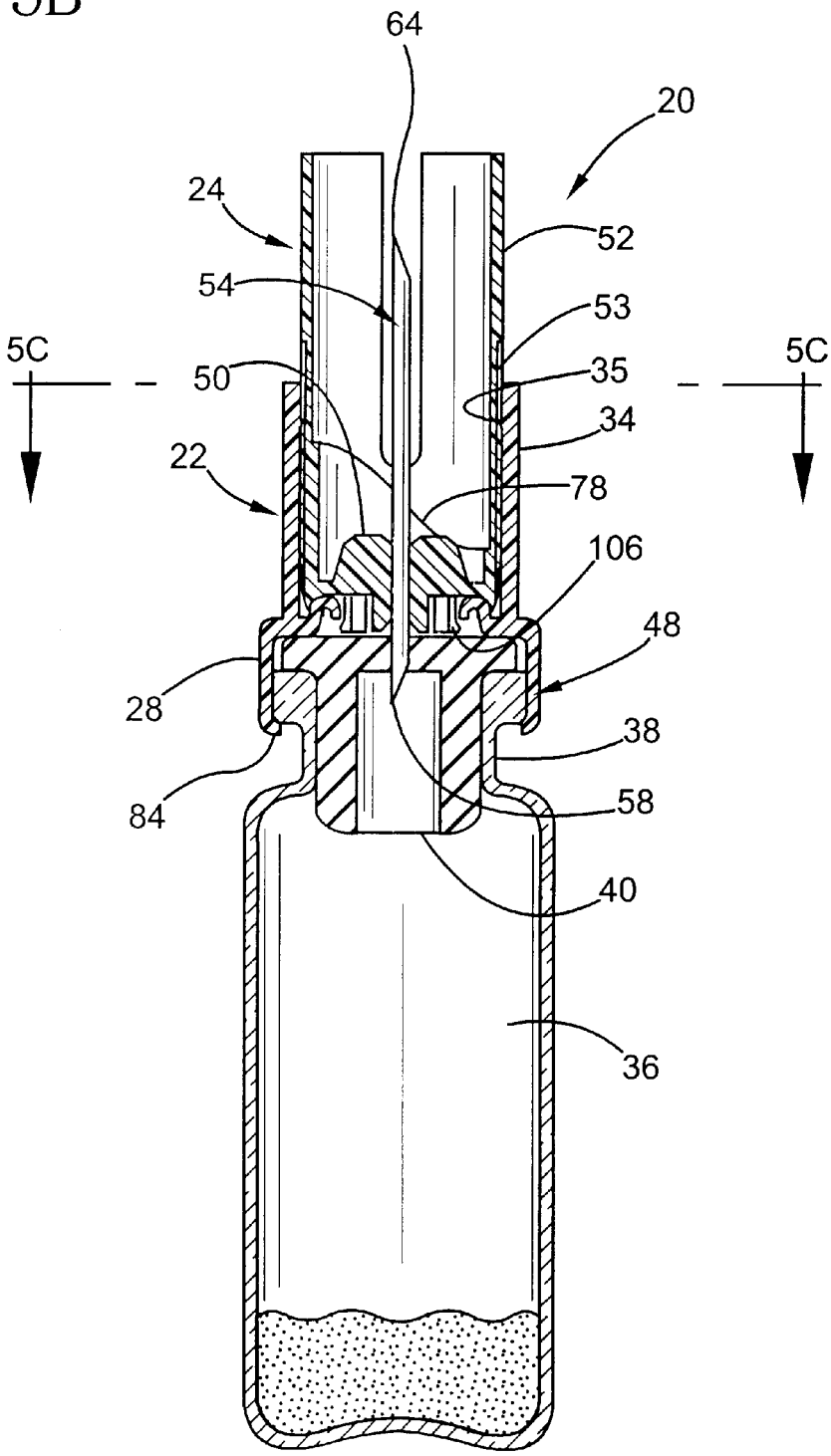
FIG. 5B is a side cross-sectional view following removal of the closure.
Figure 5C:
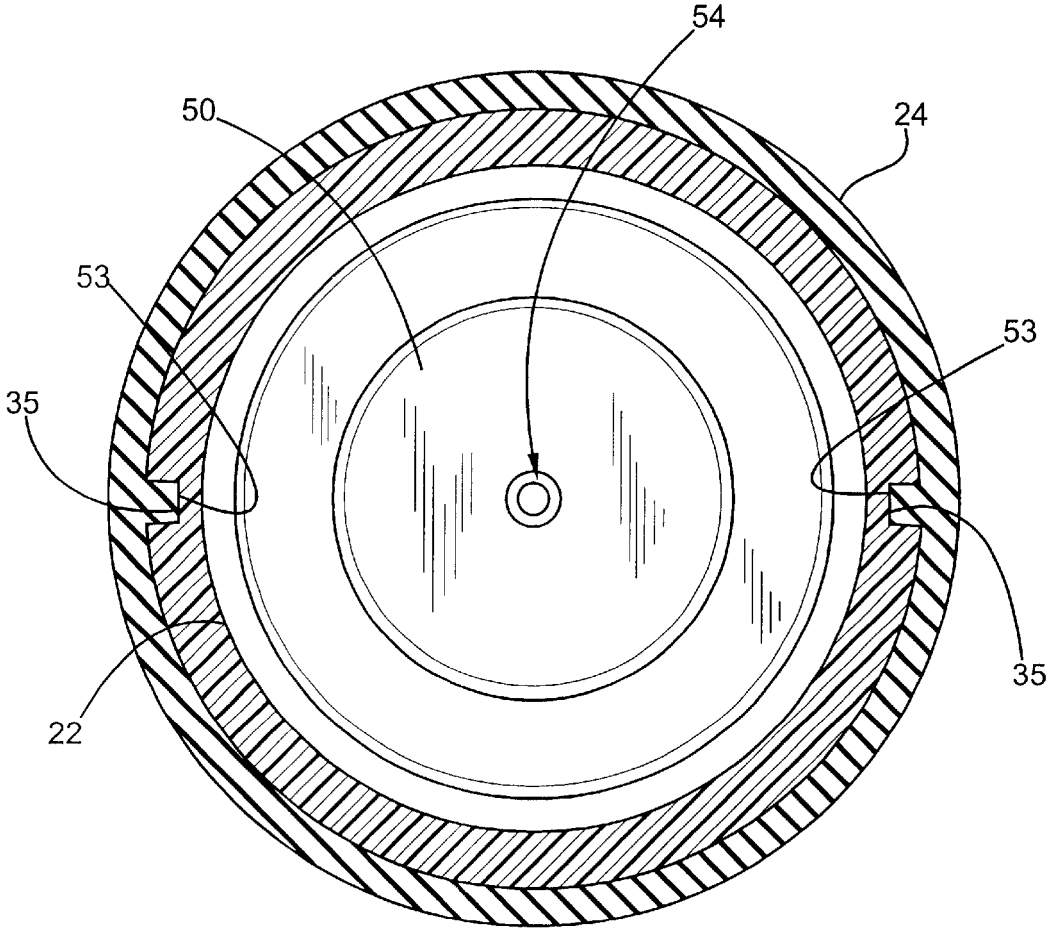
FIG. 5C is a cross-sectional view of FIG. 5B in the direction of view arrows 5C.
Figure 6:
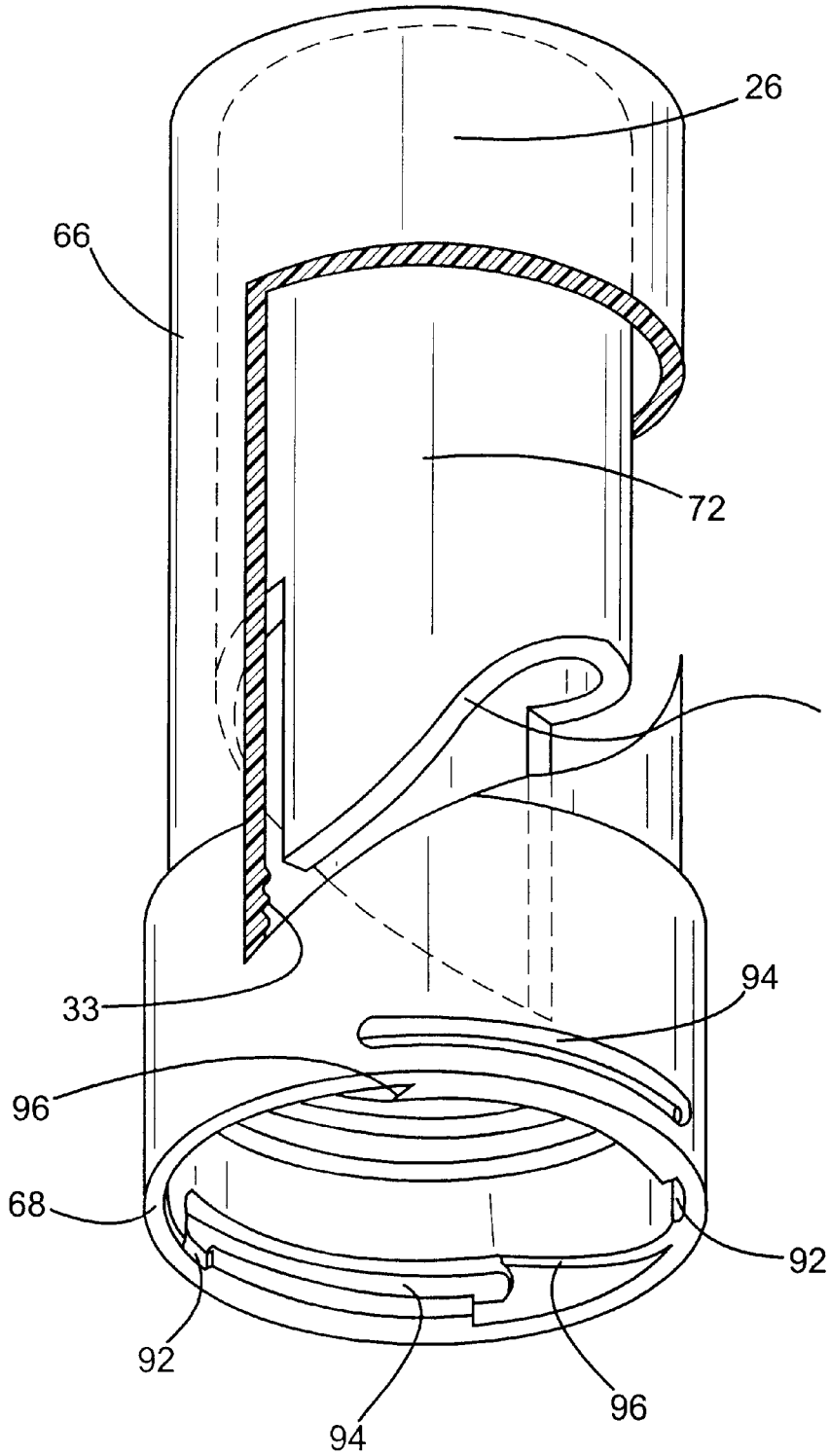
FIG. 6 is a partially cross-sectioned side perspective view of the closure.

Rotation of the needle cannula holder 48 relative to the collar 22 during axial movement of the holder is prevented by axial ribs 35 on opposed sides of the collar which are received in axial grooves 53 in the opposed side of the holder 48 as best shown in FIG. 5C. These interlocking ribs and grooves also assure accurate orientation of the holder 48 in the collar 22. FIGS. 3A and 3B illustrate the transfer assembly 20 assembled on a conventional vial 36, as described above, ready for use. As stated above, the vial may, for example, contain a dry or powdered substance which will be reconstituted with a diluent or solvent depending upon the application. As best shown in FIG. 3A, the projections or protrusions 90 are visible through the slots 94 and the location of the projections in the slots indicate to the healthcare worker that the vial and transfer set assembly is now ready for use. In addition, various tamper evident means may be utilized with the transfer set assembly of this invention to indicate tampering. In the disclosed embodiment, a tamper evident frangible bridge portion 98 extends across the slot 94 to indicate the position of the projection 90 prior to use. Tamper evident tape 100 bridges the body portion 66 of the closure 26 and the proximate tubular end portion 28 of the collar. As shown in FIG. 2D, the needle cannula and holder assembly 24 is releasably retained in the tubular distal portion 34 of the collar by radial rib 80 received in annular groove 82 as described above. In this position, the first proximate end 54 of the needle cannula 54 is spaced from the planar end 46 of the stopper and the mating camming surfaces 76 and 78 on the inner tubular portion 72 of the closure and the internal surface of the tubular distal portion 52 of the needle cannula holder respectively are in engagement as shown.

The distal tubular portion 34 of the collar 22 includes projections or protrusions 90 which are received in axial slots 92 at the proximate open end 68 of the closure 26 as the closure is telescopically received over the tubular distal portion 34 of the collar. The axial slots 92 communicate with transverse lateral slots 94. As described below, the projections 90 in the lateral slots 92 prevent removal of the closure prior to and during the initial rotation of the closure 26 relative to the collar 22. The lateral slots 94 each communicate with angled or helical camming surfaces 96 which extend to the open end 68 of the closure and which drive the closure from the collar as described below. Radial grooves 33 preferably are provided on the interior surface of the closure body portion which may be filled with silicone to improve sealing.

Figure 4A:
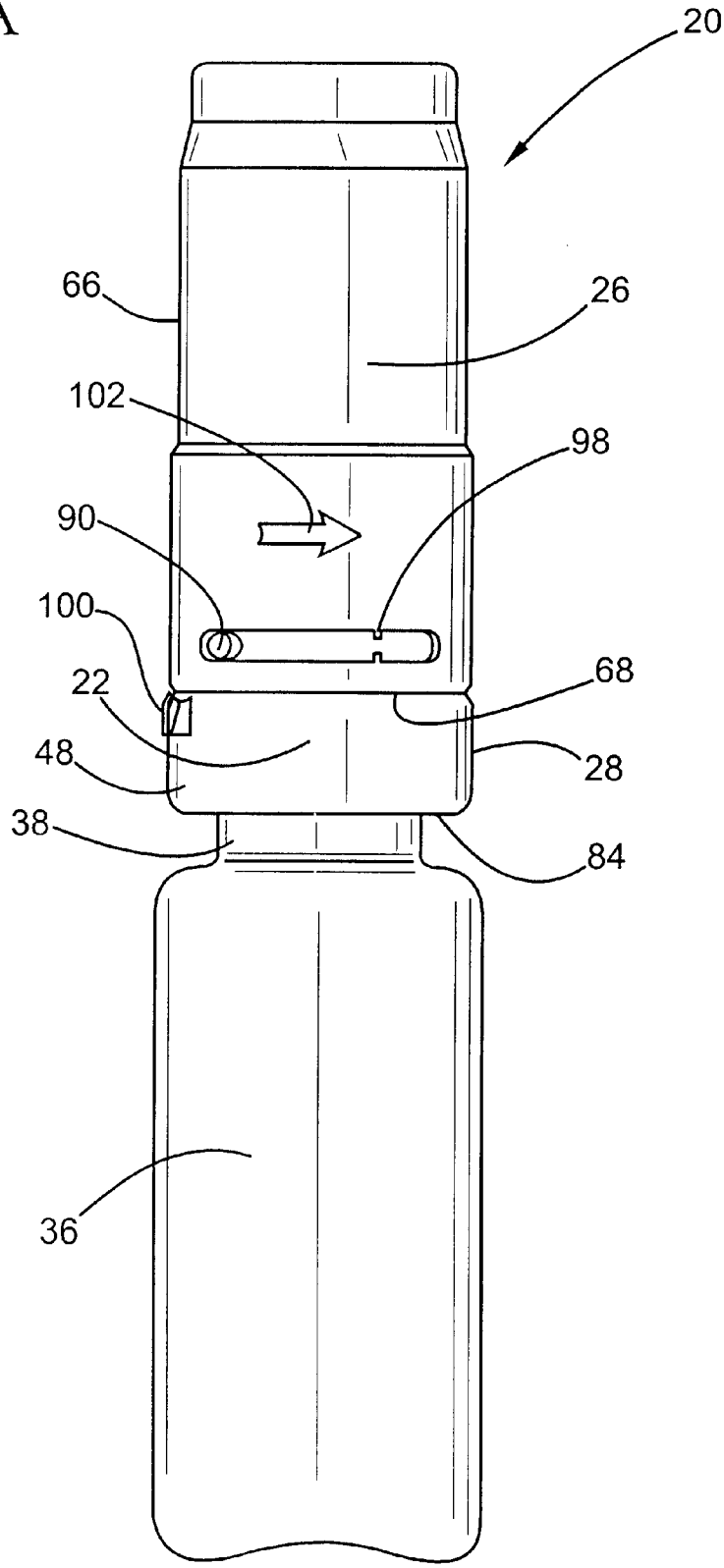
FIG. 4A is a side elevation of the transfer set and container assembly following initial rotation of the closure.
Figure 4B:
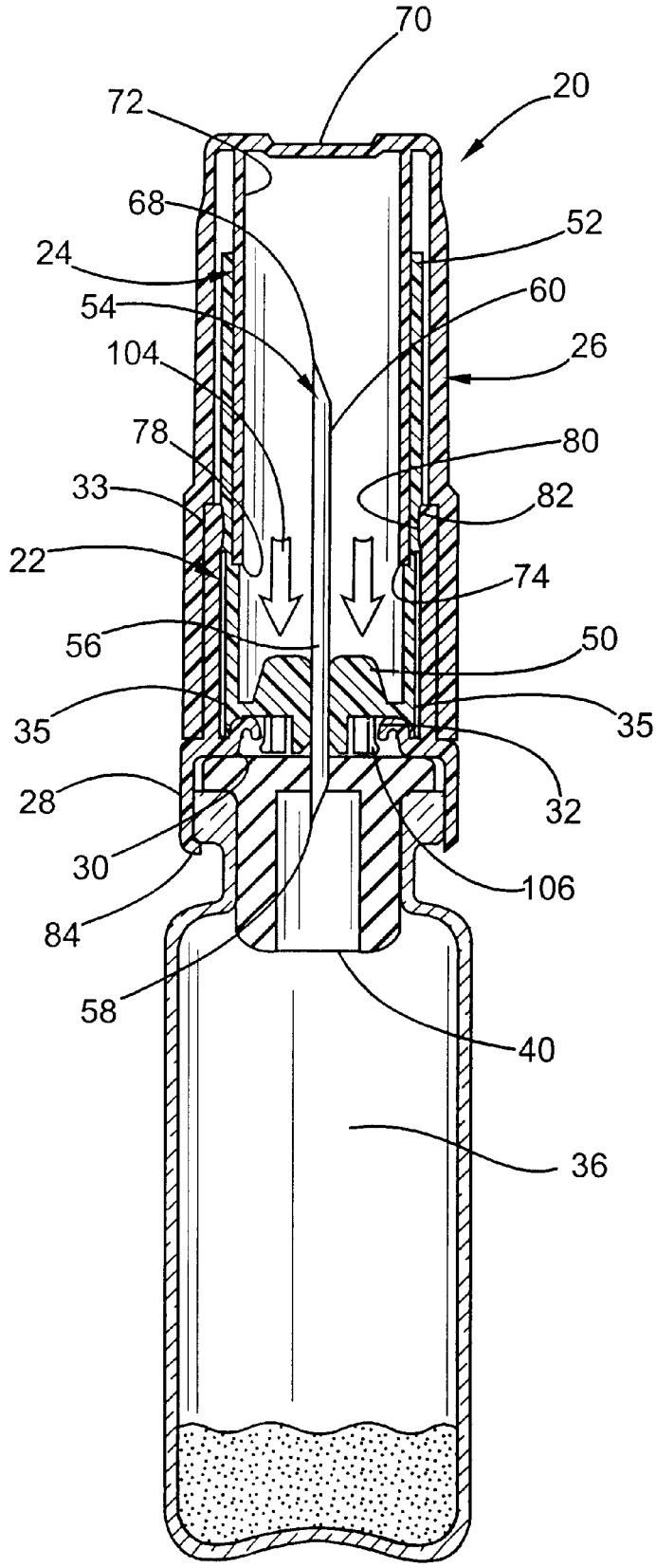
FIG. 4B is a side cross-sectional view of FIG. 4A illustrating the piercing of the seal on the container.

When the transfer set and vial assembly is ready for use, the healthcare worker rotates the closure 26 relative to the vial 36 as shown by arrow 102, which drives the mating camming surfaces 76 and 78 together, driving the needle cannula and holder assembly 24 in the direction of arrow 104. In the disclosed embodiment, the free end of the tubular distal portion 52 of the holder includes axial slots 81 which facilitate release of the holder by increasing its flexibility. The sharp edge 58 of the needle cannula then pierces the planar end portion 46 of the elastomeric stopper as shown in FIG. 4. Rotation of the needle cannula holder 48 relative to the collar 22 during axial movement of the holder is prevented by axial ribs 35 on opposed sides of the collar which are received in axial grooves 53 in the opposed sides of the holder 48. These interlocking ribs and grooves also assure accurate location of the holder 48 in the collar 22. When the needle cannula and holder assembly is fully extended as shown in FIG. 4, the hook-shaped connectors 106 (see also FIG. 2A) are received through opening 32 in the midportion of the collar and snap in place, locking the needle cannula and holder assembly as shown in FIG. 4B. As shown in FIG. 4A, rotation of the collar as described breaks the tamper evident bridging portion 98 on the lateral slots 94 and the tamper evident tape 100 bridging the closure 26 and the proximate tubular end portion 28 of the collar. As will be understood, various tamper evidence means may be utilized. Alternatively, for example, the bridge 98 may be replaced by a thin integral plastic web formed during molding of the cover. As best shown in FIG. 2A, the opening 32 through the intermediate portion 30 of the collar 22 is generally cone-shaped and the hook-shaped elements 106, which may be molded integral with the intermediate portion 50, provide guidance for the hook-shaped elements and secure retention of the needle cannula and holder assembly.

Figure 7:
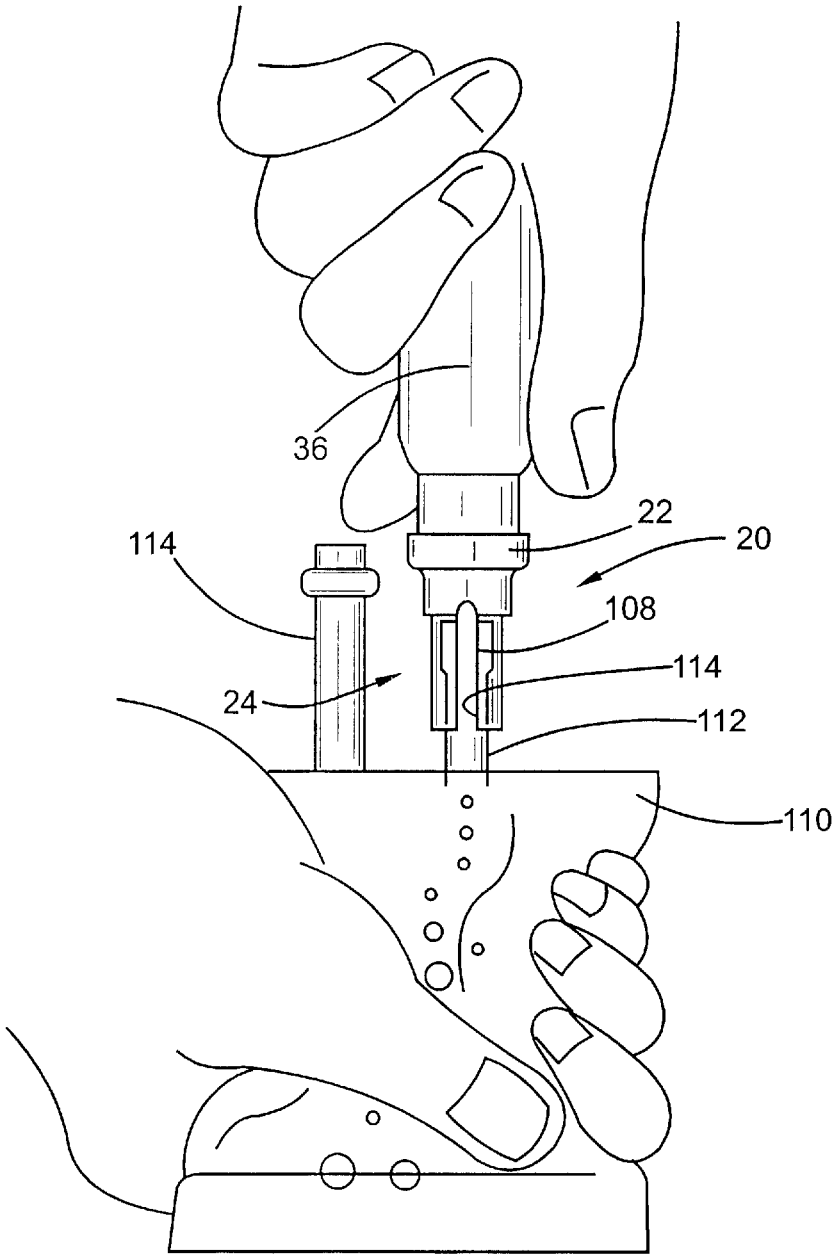
FIG. 7 is a side view of the transfer set and a conventional intravenous infusion bag illustrating one use of the transfer set assembly of this invention.
Figure 8:
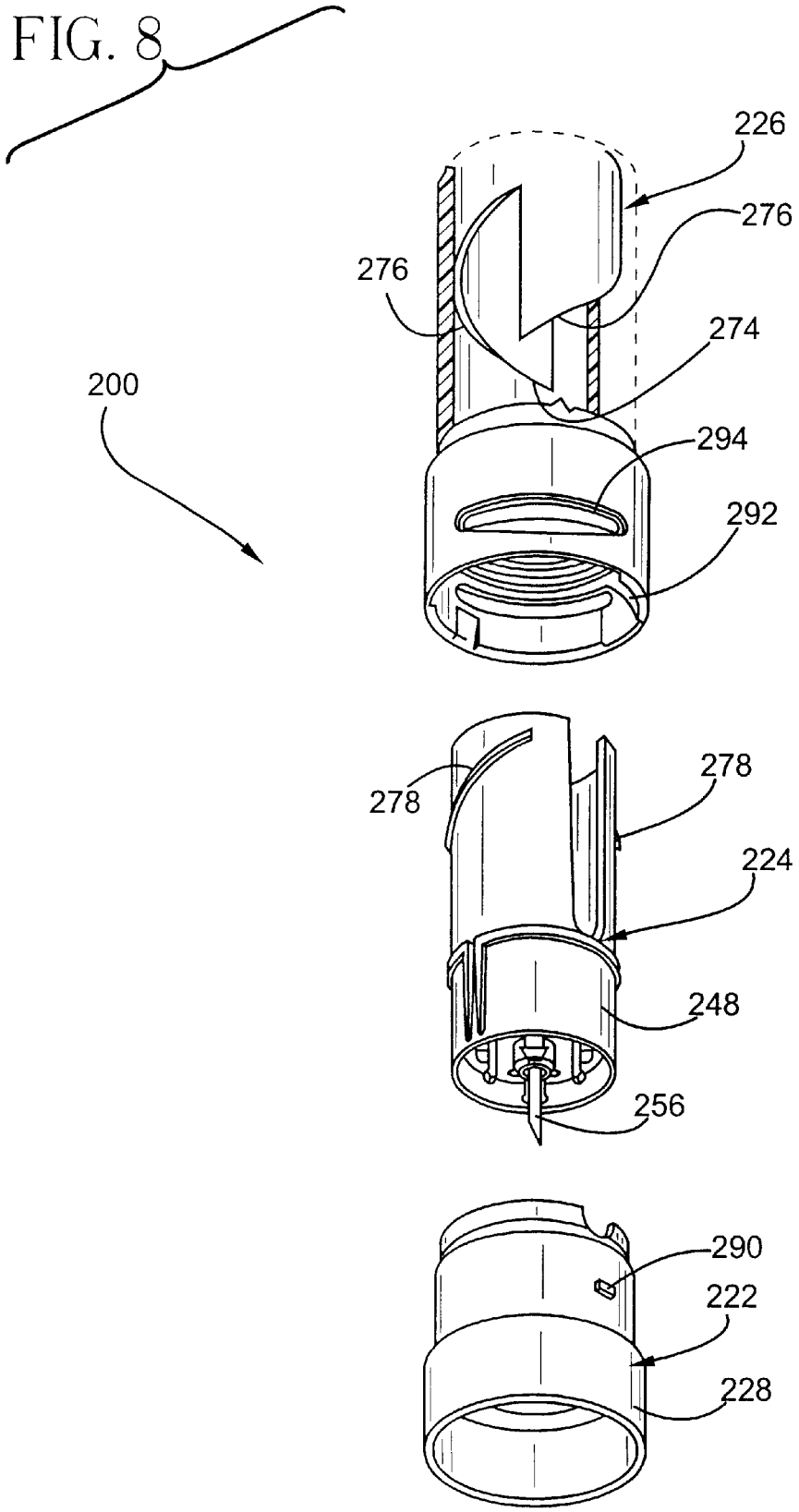
FIG. 8 illustrates another example of a transfer set designed according to this invention.
Figure 9:
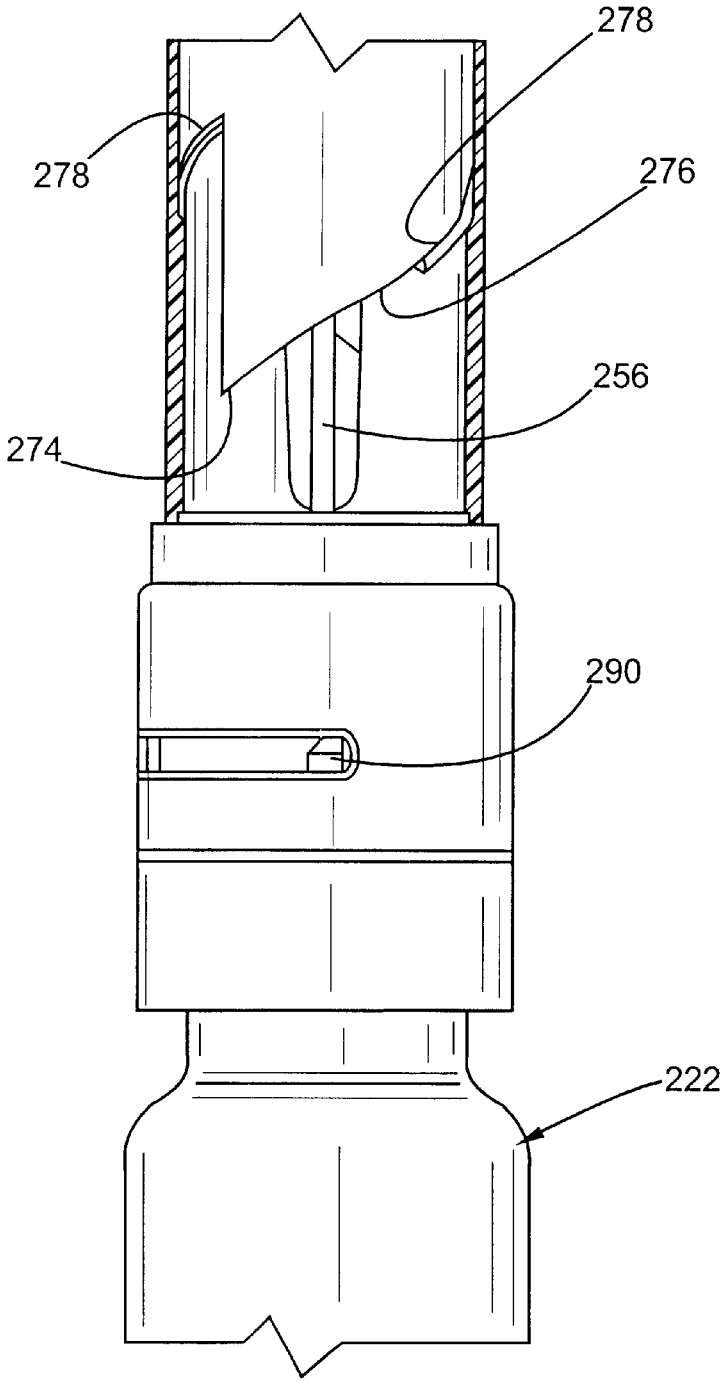
FIG. 9 is a partial cross-sectional view of the embodiment of FIG. 8 in a first position.
Figure 10:
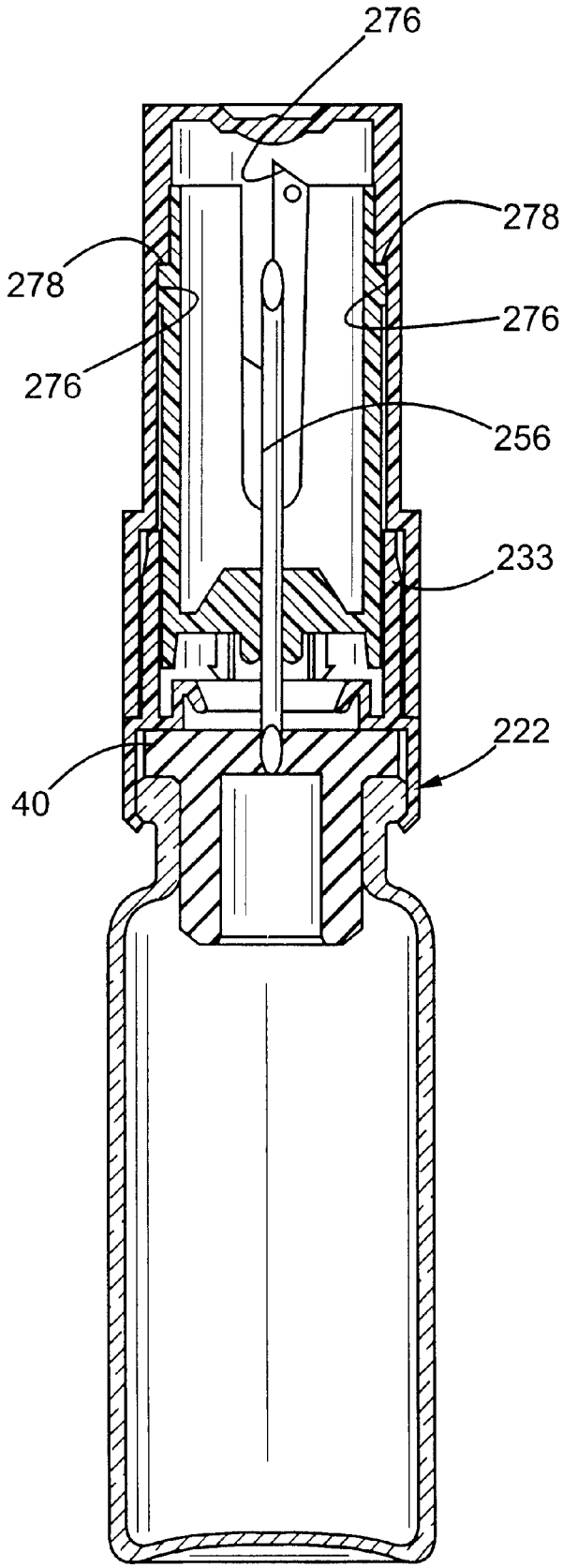
FIG. 10 is a cross-sectional view of the embodiment of FIG. 9.
Figure 11:
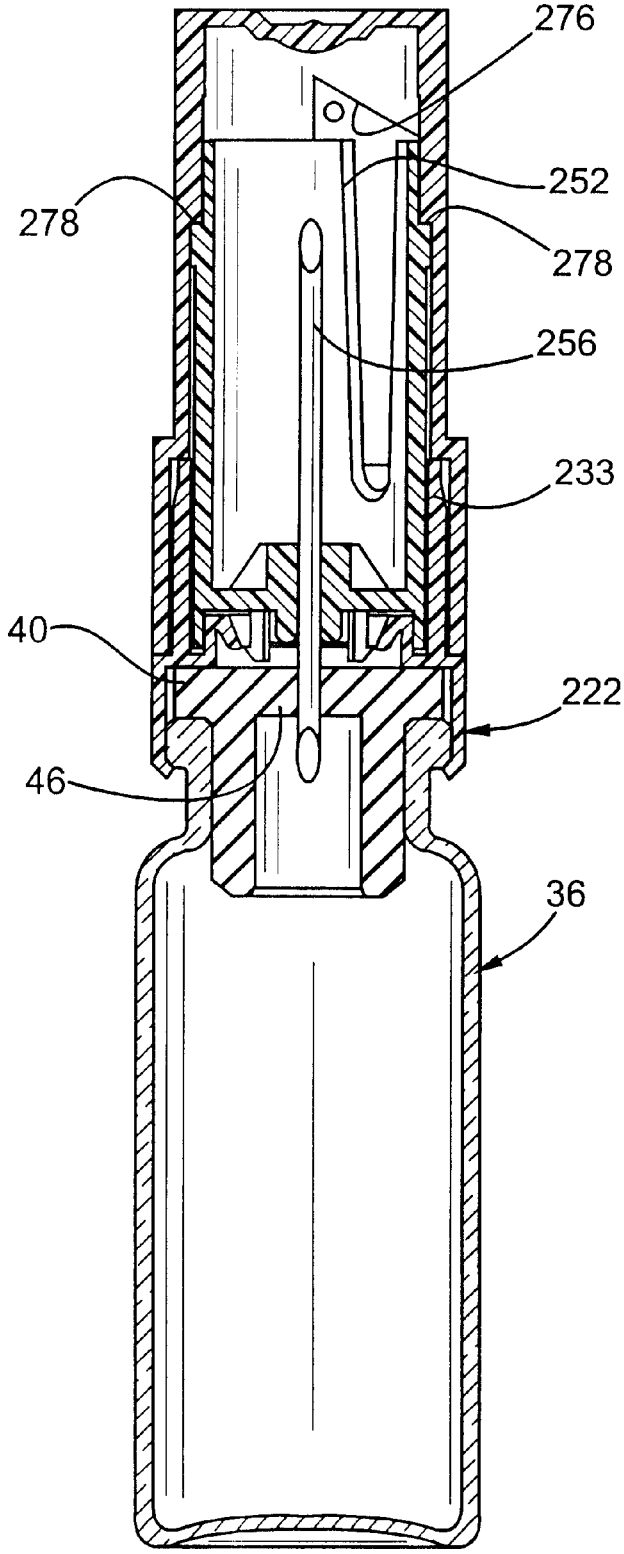
FIG. 11 is a cross-sectional view of the embodiment of FIG. 8 in a second position.

Continued rotation of the closure 26 in the direction of arrow 102 in FIG. 5 disposes the projections 90 against the angled camming surfaces 96 which, as described above, are contiguous with the lateral slots 94, thereby driving the closure 96 away from the proximate tubular end portion 28 of the collar, releasing the collar and providing clear indication to the healthcare worker that the transfer set and vial assembly is ready for use to transfer fluids from the vial to a second container. The closure 26 is then removed as shown in FIG. 5B, exposing the distal end portion 60 of the needle cannula. Where the transfer set assembly is adapted for transfer of fluids between the vial and a second container having a tubular port, as shown for example in FIG. 7 and described below, the tubular distal portion 52 preferably extends beyond the sharp edge 64 of the distal end portion 60 of the needle cannula as seen in FIG. 5. As shown in FIGS. 1 and 7, axial slots 108 may be provided in the tubular distal portion of the needle cannula holder 24 to permit the healthcare worker to clearly see the location of the needle cannula for installation.

FIG. 7 illustrates one use of the transfer set assembly 20 of this invention for transferring fluid between a vial 36 and an IV infusion bag 110. As shown, the axial slot 108 in the tubular distal portion permits the healthcare worker to easily view the distal end portion 60 of the needle (not shown) in FIG. 7 and the tubular distal portion 52 of the needle holder guides the tubular port 112 of the infusion bag to pierce the seal in the end of the tubular port 112. A conventional infusion bag includes two tubular ports 112 and 114 for use with different transfer sets and hypodermic needles. In a conventional application where the vial includes a dry or powdered medicament, the liquid in the IV infusion bag 110 is first transferred to the powdered medicament in the vial with the infusion bag located above the vial. Once the transfer set is connected to the tubular port 112 as described, fluid communication is provided through the needle cannula and the infusion bag. The liquid is transferred to the vial by squeezing the IV infusion bag, which transfers fluid from the infusion bag to the vial, reconstituting the drug in the vial. The infusion bag is then reversed as shown in FIG. 7 and the reconstituted drug is then transferred from the vial to the infusion bag. This method of transferring fluid from a vial or other container to an IV infusion bag is well known in the art and therefore no further description is required.

FIGS. 8 through 11 illustrate another preferred embodiment of a transfer set assembly designed according to this invention. There are substantial similarities between this example and that discussed above and as shown in FIGS. 1 through 6. Therefore, similar numbering with an increase by 200 have been used in the drawings to avoid the need for duplicate descriptions.

The closure 226 of this example does not include the inner tubular portion 72 that was used in the previous example. Instead, the closure 226 includes camming surfaces 276 formed on the inside or interior surface of the closure 226. Additionally, the camming surfaces 278 are relocated relative to the surfaces 78 in the previous example. In this assembly, the camming surfaces 278 are positioned on the outside surface of the needle holder portion 224. The camming surfaces 276 cooperate with the camming surfaces 278 in the same manner as the camming surfaces described in the previous example. Otherwise, the operation of the embodiment shown in FIGS. 8 through 11 preferably is identical to the example of FIGS. 1 through 6. The rotation of the closure 226 causes movement of the needle holder portion 224 to secure the needle holder portion in place and to make fluid communication through the needle 256 possible to transfer fluid into or out of the container to which the assembly is attached in the same manner as described above.

The location of the camming surfaces in the example of FIGS. 8 through 11 is advantages from a manufacturing standpoint. There is no need to include the inner tubular portion 72 and, therefore, less material is required and the mold used in a molding process is not as complex. Given this description, those skilled in the art will realize which of the disclosed embodiments, or other modified arrangements, will best suit their needs for a particular circumstance.

As will now be understood, the transfer set assembly of this invention is simple to use and provides a substantially foolproof operation. The transfer set of this invention may be utilized with any sealed container, including but not limited to conventional vials, and may be utilized to transfer fluids between the sealed container and any conventional container including, for example, an IV infusion bag. The transfer set of this invention assures sterile conditions of the transfer set and the medicament within the sealed container during filling of the container and use of the container assembly. Further, the transfer set assembly of this invention protects the healthcare worker and provides a positive indication of the piercing of the seal on the vial or other container and release of the closure. As will also be understood, various modifications may be made to the disclosed transfer set of this invention within the purview of the appended claims. For example, the collar 22 may be modified to accommodate other containers and various materials may be utilized for the components of the transfer set assembly of this invention. Finally, the unique features of the transfer set assembly of this invention may be used alone or in combination with the disclosed components providing a wide range of use for the transfer set of this invention.

What is claimed is:

1. A transfer set assembly for transferring fluids between a first container having a sealed open end and a second container under sterile conditions, said transfer set assembly comprising:

a collar, a needle cannula holder, a needle cannula and a closure;

said collar having a proximate tubular end portion adapted to be received over said sealed open end of said first container for securement thereto, an intermediate portion having an axial opening therethrough and a distal tubular portion;

said needle cannula holder having a proximate end portion telescopically received in said distal tubular portion of said collar and a tubular distal end portion and said tubular distal end portion having a spiral camming surface;

said needle cannula supported in said holder having a free proximate end portion projecting axially beyond said proximate end portion of said holder;

said closure having a tubular body portion surrounding said needle cannula holder and said distal tubular portion of said collar, a closed distal end portion and an inner tubular portion generally coaxially aligned with said tubular body portion having a spiral camming surface adjacent a free end of said inner tubular portion and engaging said spiral camming surface of said holder; and whereby, rotation of said closure relative to said holder drives said needle cannula and holder assembly axially to pierce said sealed open end of said first container.

2. The transfer set assembly defined in claim 1, wherein said inner tubular portion of said closure has a free end having at least two spiral camming surfaces engaging spiral camming surfaces on said holder.

3. The transfer set assembly defined in claim 2, wherein said inner tubular portion of said closure is telescopically received within said tubular distal portion of said holder and said spiral camming surfaces on said holder are located on an internal surface of said tubular distal portion of said holder.

4. The transfer set assembly defined in claim 3, wherein said inner tubular portion of said closure is integral with said closed distal end and said free end of said inner tubular portion is spaced from said closed distal end of said closure.

5. The transfer set assembly defined in claim 1, wherein said distal tubular portion of said collar and said needle cannula holder have an interlocking axial rib and groove which permit telescopic movement of said holder within said distal tubular portion of said collar while preventing rotational movement of said holder relative to said collar.

6. The transfer set assembly defined in claim 1, wherein one of said closure tubular body portion and said collar distal tubular portion include an angled camming surface and the other of said closure tubular body portion and said collar distal tubular portion includes a projection engaging said angled camming surface, whereby rotation of said closure relative to said collar drives said closure away from said collar.

7. The transfer set assembly defined in claim 6, wherein said projection is on said collar distal tubular portion and said camming surface is on an internal surface of said closure tubular body portion.

8. The transfer set assembly defined in claim 7, wherein said closure tubular body portion includes a laterally extending slot adjacent said camming surface, said projection on said collar initially received in said lateral slot in said closure tubular body portion, whereby rotation of said closure relative to said collar first drives said needle cannula and holder assembly axially to pierce said sealed open end of said first container as said projection rotates in said later slot, then driving said closure away from said collar as said projection is received against said camming surface on said closure body portion.

9. The transfer set assembly defined in claim 6, wherein said closure is releasably retained to said collar by a frangible connector, whereby rotation of said closure relative to said collar brakes said frangible connector, releasing said closure from said collar.

10. The transfer set assembly defined in claim 1, wherein said proximate end portion of said holder has an axial opening receiving and retaining said needle cannula, said holder proximate end portion having a plurality of hook-shaped connectors which are received in said axial opening in said intermediate portion of said collar retaining said needle cannula and holder assembly to said collar after said needle cannula pierces said sealed opened end of said first container.

11. A transfer set assembly for transferring fluids between a first container having a sealed open end and a second container under sterile conditions, said transfer set assembly comprising:

a collar, a needle cannula holder, a needle cannula and a closure;

said collar having a tubular collar portion adapted to be received over said sealed open end of said first container for securement thereto and a distal tubular portion coaxially aligned with said tubular collar portion;

said needle cannula holder having a proximate end portion telescopically received in said distal tubular portion of said collar having a spiral camming surface;

said needle cannula supported in said needle cannula holder having a free proximate end portion projecting axially beyond said needle cannula holder;

said closure having an outer tubular body portion surrounding said needle cannula holder and said distal tubular portion of said collar, a closed distal end portion and an inner tubular portion extending from said closed distal end portion generally coaxially aligned with said outer tubular body portion including a free end spaced from said closed distal end portion;

said free end of said inner tubular portion of said closure defining a spiral camming surface engaging said spiral camming surface of said needle cannula holder;

whereby, rotation of said closure relative to said needle cannula holder drives said needle cannula holder and said needle cannula axially to pierce said sealed open end of said first container.

12. The transfer set assembly as defined in claim 11, wherein said spiral camming surface of said needle cannula holder is defined on an inside surface of said distal tubular portion.

13. The transfer set assembly defined in claim 12, wherein said inner tubular portion of said closure has an outer diameter generally equal to an inner diameter of said distal tubular portion of said needle cannula holder and said spiral camming surface of said needle cannula holder projects from said inside surface.

14. The transfer set assembly defined in claim 11, wherein said outer tubular body portion of said closure includes a laterally extending slot and a spiral camming surface contiguous with said slot and said distal tubular portion of said needle cannula holder having a projection received in said laterally extending slot in said closure outer tubular body portion, whereby rotation of said closure relative to said collar first drives said needle cannula and needle cannula holder axially to pierce said sealed open end of said container as said projection rotates in said laterally extending slot, then driving said closure away from said collar as said projection is received in said spiral camming surface on said closure outer body portion.

15. The transfer set assembly defined in claim 14, wherein said needle cannula holder is releasably retained in said tubular collar portion as said projection is rotated in said laterally extending slot.

16. The transfer set assembly defined in claim 15, wherein said needle cannula holder is releasably retained in said collar by a resilient hook-shaped connector received in an axial opening in an intermediate portion of said collar releasably retaining said needle cannula holder to said collar after said needle cannula pierces said sealed open end of said container.

* * * * *